US009072960B1

(12) United States Patent
Polk, III et al.

(10) Patent No.: US 9,072,960 B1
(45) Date of Patent: Jul. 7, 2015

(54) SHOOTER/CATCHER APPARATUS

(71) Applicant: Leisure, Inc., Eden Prairie, MN (US)

(72) Inventors: Louis F. Polk, III, Excelsior, MN (US); Louis Polk, IV, Excelsior, MN (US); Caleb Summers, St. Louis Park, MN (US); Randy Peterson, Victoria, MN (US)

(73) Assignee: Whiteboard Product Solutions, Eden Prairie, MN (US)

( * ) Notice: Subject to any disclaimer, the term of this patent is extended or adjusted under 35 U.S.C. 154(b) by 34 days.

(21) Appl. No.: 13/763,999

(22) Filed: Feb. 11, 2013

Related U.S. Application Data

(60) Provisional application No. 61/597,392, filed on Feb. 10, 2012.

(51) Int. Cl.
*A63F 7/00* (2006.01)
*B65D 75/36* (2006.01)

(52) U.S. Cl.
CPC .. *A63F 7/00* (2013.01); *B65D 75/36* (2013.01)

(58) Field of Classification Search
USPC ..... 273/108.1, 108.5, 126 R, 127, 127 D; 124/10, 16, 31, 47
See application file for complete search history.

(56) References Cited

U.S. PATENT DOCUMENTS

| | | | | |
|---|---|---|---|---|
| 1,034,716 | A | | 8/1912 | Kruger |
| 1,222,996 | A | | 4/1917 | Rhodes |
| 1,313,327 | A | | 8/1919 | Parker |
| 2,097,106 | A | | 10/1937 | Stewart |
| 2,129,461 | A | * | 9/1938 | Boerger ..... 124/10 |
| 2,541,392 | A | | 2/1951 | Weiss |
| 2,636,738 | A | | 4/1953 | Abagoff |
| 2,945,485 | A | * | 7/1960 | Skreberg ..... 124/4 |
| 3,018,584 | A | * | 1/1962 | Passariello ..... 446/259 |
| 3,061,311 | A | * | 10/1962 | Von Arnhem ..... 473/505 |
| 3,570,467 | A | | 3/1971 | Belokin |
| 3,895,800 | A | | 7/1975 | King |
| 4,145,050 | A | | 3/1979 | Sullivan et al. |
| 4,157,828 | A | * | 6/1979 | Cosmopulos ..... 473/510 |
| 4,277,068 | A | | 7/1981 | Sasaki |
| 4,781,642 | A | | 11/1988 | Stanzel |
| 4,871,170 | A | * | 10/1989 | Carini ..... 273/126 R |
| 4,872,688 | A | * | 10/1989 | Galvin ..... 473/509 |
| 5,232,226 | A | * | 8/1993 | Glickson ..... 473/510 |
| 5,289,916 | A | | 3/1994 | Mickelberg |
| 5,292,134 | A | | 3/1994 | Schlundt et al. |
| D346,183 | S | * | 4/1994 | Crane ..... D21/443 |
| 5,362,065 | A | | 11/1994 | Su |
| 5,435,447 | A | | 7/1995 | Weatherford et al. |
| 5,471,967 | A | | 12/1995 | Matsuzaki et al. |
| 5,494,252 | A | | 2/1996 | Amit et al. |
| 5,595,295 | A | | 1/1997 | Lin |
| 5,611,321 | A | | 3/1997 | Hoeting et al. |
| 5,622,258 | A | | 4/1997 | Baublitz et al. |
| 5,718,335 | A | | 2/1998 | Boudreaux |

(Continued)

*Primary Examiner* — Nini Legesse
(74) *Attorney, Agent, or Firm* — Haugen Law Firm PLLP

(57) ABSTRACT

A game apparatus involving launching and catching of a game piece includes a pincer tool having first and second opposed members that are articulatable with respect to one another to capture the game piece between the articulatable members, and to also accelerate the game piece radially outwardly from a pivot region. The pincer tool of the game apparatus therefor acts to launch the game piece merely through relative articulation of the opposed first and second members toward one another while the game piece is in contact with both of the first and second members.

11 Claims, 12 Drawing Sheets

(56) References Cited

U.S. PATENT DOCUMENTS

| | | | |
|---|---|---|---|
| 5,996,564 | A | 12/1999 | Kotowski |
| 6,030,274 | A | 2/2000 | Kaplan |
| 6,126,008 | A | 10/2000 | Cox |
| 6,146,231 | A | 11/2000 | Rachmany |
| 6,311,839 | B1 | 11/2001 | Lo |
| 6,401,932 | B1 | 6/2002 | Weinstein et al. |
| D462,903 | S | 9/2002 | Yuen |
| 6,467,617 | B1 | 10/2002 | Chen |
| D481,941 | S | 11/2003 | Kyne et al. |
| 6,899,222 | B2 | 5/2005 | Jones et al. |
| 7,044,305 | B2 | 5/2006 | Girondi et al. |
| 7,481,691 | B2 | 1/2009 | Sze |
| 7,568,578 | B2 | 8/2009 | Berman |
| 7,832,561 | B2 | 11/2010 | Polk, III |
| 2002/0162771 | A1 | 11/2002 | Van Wagenen et al. |

* cited by examiner

SHOOTER/CATCHER APPARATUS

CROSS-REFERENCE TO RELATED APPLICATIONS

This application claims priority to U.S. Provisional Patent Application Ser. No. 61/597,392, filed on Feb. 10, 2013 and entitled "SHOOTER/CATCHER APPARATUS", the content of which being incorporated herein in its entirety.

FIELD OF THE INVENTION

The present invention relates to projectile shooting and catching generally, and more particularly to an apparatus for playing a game involving a projectile that may be directed under force by a tool toward an opponent's goal. The goal into which the projectile is aimed may be a stationary region at the game playing surface, or may instead be connected to, or a portion of, a projectile shooter tool that is adapted for movement in the game playing region, as directed by the user's hands.

BACKGROUND OF THE INVENTION

Game apparatus involving a game piece that is propelled under force by a player-manipulated tool have been developed in a wide array of applications. Such game apparatus may be exemplified in pinball-type games, as well as board games in which players attempt to score goals from opposite ends of the game playing region. Game pieces utilized in such apparatus may include, for example, balls, pucks, disks, and other three-dimensional objects that can be propelled by a tool manipulated by the game player.

Typically, the tool for propelling the game piece is a striker body which imparts a velocity to a game piece through a physical impact in which the striker device has been accelerated by the user to a desired velocity. In this manner, the momentum of the striker device, as a product of its mass and its velocity, may be transmitted to the game piece through a physical striking action, so as to develop a desired velocity in the game piece.

The physical impacts between the striker device and the game piece in conventional game apparatus can develop unwanted noise, and has the potential of causing injury to the players' fingers or other body parts in the event that they come in between the striker device and the game piece in the process of striking the game piece. Moreover, and particularly in the case of game apparatus which involves propelling a game piece toward an opponent's goal, a striker device-based propulsion system reveals the opponent's intentions for the velocity (speed and direction) of the game piece substantially prior to the actual striking of the game piece. In this way, the player can anticipate game piece movement through the observation of the opponent's movement of the striker device. Such anticipation limits the opponent's opportunity to score goals, which can also limit the enjoyment of the game.

It is therefore an object of the present invention to provide a game apparatus involving the propulsion of a game piece, wherein the player propels the game piece without a striking impact force. Instead, propulsion is obtained merely through "squeezing" forces imparted upon the game piece by a game tool. Velocity and the timing of game piece propulsion may therefore be substantially concealed to make it more difficult for the opponent to anticipate the "shooting" characteristics of the game piece.

It is another object of the present invention to provide a game apparatus that is inexpensive to manufacture, and may be compactly packaged.

It is a further object of the present invention to provide a packaging for a game apparatus which permits game play demonstration while the game apparatus is inside of the packaging.

It is another object of the present invention to provide a game apparatus tool that is capable of simultaneously catching and re-launching a game piece through a single manipulation of the tool.

SUMMARY OF THE INVENTION

By means of the present invention, an interactive moving game piece game is provided which involves simple and inexpensive game device that can be used on nearly any relatively flat surface. Game play involves user manipulation of a game tool, wherein a projectile game piece may be caught and/or launched toward an opponent's goal by squeezing or pinching opposed members toward one another.

In one embodiment, the game apparatus of the present invention includes a game surface defining a game area and a game piece for movement upon the game surface. A pincer tool for catching and discharging the game piece along the game surface under force includes first and second opposed members extending from a pivot region to be articulatable about a pivot axis of the pivot region. The discharge portion of the pincer tool is capable of accelerating the game piece radially outwardly from the pivot axis by articulating at least one of the first and second opposed members about the pivot axis toward another of the first and second opposed members while the game piece is in contact with both of the first and second opposed members at the discharge portion. The pincer tool includes a receptacle that is arranged to receive the game piece at a goal position radially inwardly of the discharge portion, with the receptacle being defined by respective receptacle portions of the first and second opposed members proximate to the pivot region with respect to the discharge portion.

DETAILED DESCRIPTION OF THE PREFERRED EMBODIMENTS

Figure 1:
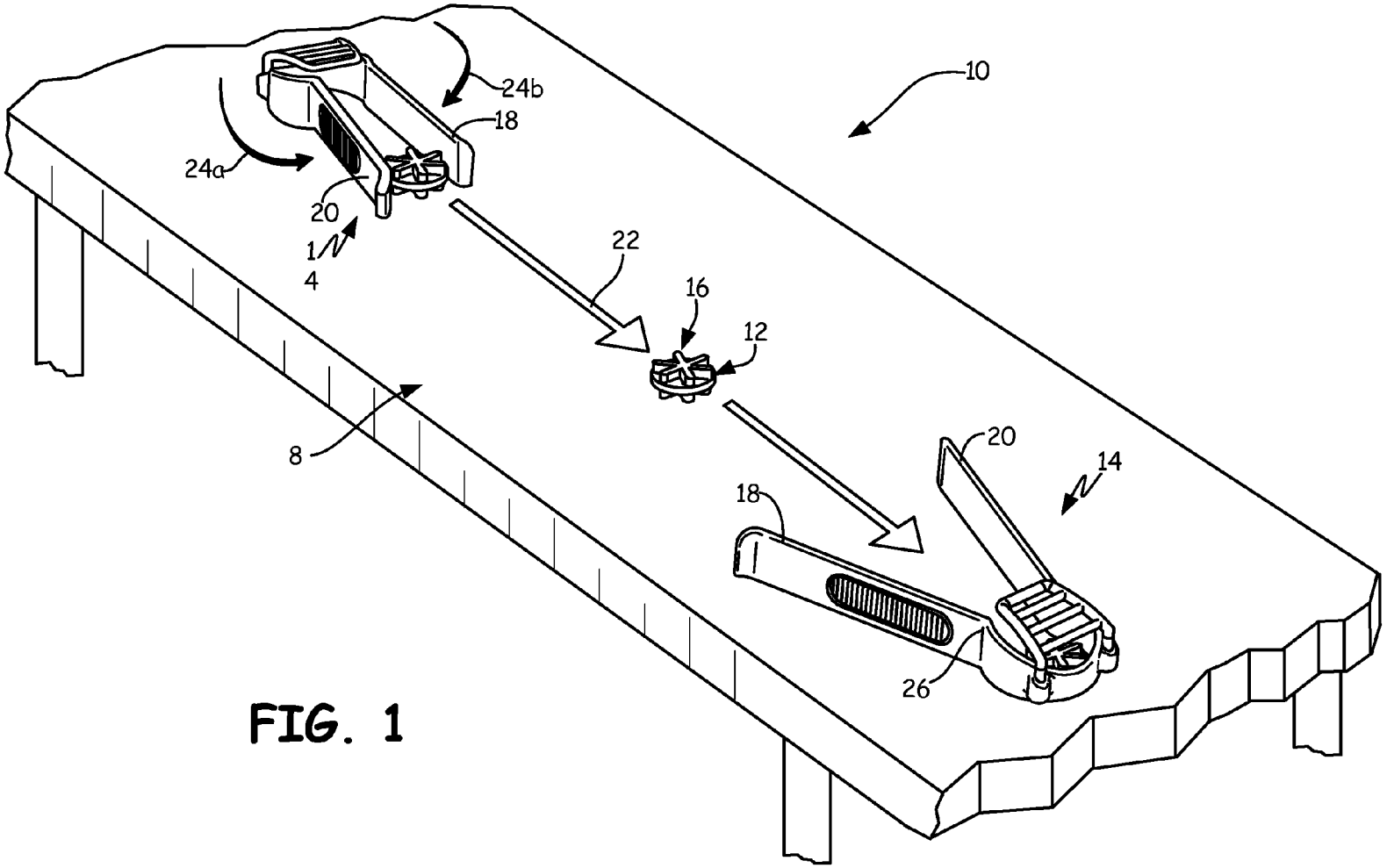
FIG. 1 is a schematic illustration of a game apparatus of the present invention.

The objects and advantages enumerated above together with other objects, features, and advances represented by the present invention will now be presented in terms of detailed embodiments described with reference to the attached drawing figures, which are intended to be representative of various possible configurations of the invention. Other embodiments and aspects of the invention are recognized as being within the grasp of those having ordinary skill in the art.

Unless otherwise apparent or stated, directional references, such as "upper", "lower", "inner", "outer", "top", "bottom", and the like are intended to be relative to the orientation of a particular embodiment of the invention as shown in the figures. In addition, a given reference numeral in the drawings indicates the same or similar structure when it appears in different figures, and like reference numerals identify similar structural elements and/or features of the subject invention.

With reference now to the drawing figures, and first to FIG. 1, a game apparatus 10 of the present invention is illustrated as being playable upon a game surface 8 defining a game area 5. Game apparatus 10 includes a game piece 12 for movement upon game surface 8, and one or more pincer tools 14 adapted to both arrest movement of game piece 12, and to propel game piece 12 along game surface 8. In the illustrated embodiment, one or more pincer tools 18 may be employed in game apparatus 10, and may be manipulated by one or more players. A typical game playing mode envisioned by the applicant is a single pincer tool 14 manipulated by a single respective player, such that two opposing players may manipulate a respective pincer tool 14 to maneuver game piece 12 along game surface 8.

Game surface 8 is contemplated as constituting a variety of relatively smooth or low-friction surfaces to minimize drag forces on the motion of game piece 12. Example game surfaces 8 may include table tops, counter tops, hard floor surfaces, and the like. Game piece 12 is illustrated in a substantially disk-like configuration with a raised surface pattern 16 for reducing contact friction with game surface 8. It is to be understood, however, that game piece 12 may assume a variety of configurations, such as a disk, cylinder, sphere, cube, parallelpiped, and other regular or irregular configurations. It is therefore anticipated that movement of game piece 12 upon game surface 8 may include any of sliding, rolling, tumbling, rotating, and combinations thereof. As a result, game piece 12 may be provided in a variety of configurations that cooperate with pincer tools 14 to facilitate motivation of game piece 12 upon and/or along game surface 8.

It is also contemplated, however, that game piece 12 may be used by pincer tools 14 without game surface 8. For example, first and second opposed members 18, 20 may be specifically configured to hold game piece 12 so that game piece 12 may be discharged through the air to a target, including to another pincer tool 14. Thus, apparatus 10 need not be employed on a surface, and may instead be used to launch and catch game piece 12 through the air or other medium.

As illustrated in FIG. 1, pincer tools 14 are arranged to motivate and catch game piece 12 by "pinching" or "squeezing" first and second opposed members 18, 20 toward one another. The configuration of pincer tools 14 permits not only catching game piece 12 between first and second opposed members 18, 20, but also permits the propulsion of game piece 12 in an opposite direction upon the continued relative motion of first and second opposed members 18, 20 toward one another. Articulation of first and second members 18, 20 in a manner to "launch" or propel game piece 12 along direction 22 upon game surface 8 is indicated by directional arrows 24*a*, 24*b*. Game piece 12 may be propelled in a direction toward, and possibly received in a receptacle 26 of an opponent's pincer tool 14. In one embodiment, achieving the reception of game piece 12 in an opponent's receptacle 26 constitutes a goal of the game.

In one aspect of the present invention, pincer tools 14 may be manipulated to catch game piece 12 by arresting movement thereof between first and second opposed members 18, 20. In such manner, a player may use pincer tool 14 in a manner to simply stop movement of game piece 12 through a pinching manipulation of first and second opposed members 18, 20 along directional arrows 24*a*, 24*b* until arresting contact is established between members 18, 20 and game piece 12. The player may then elect to launch or propel game piece 12 along direction 22 by further pinching or squeezing first and second opposed members 18, 20 toward one another. In one approach, a player may simultaneously catch and relaunch game piece 12 with a single squeezing manipulation of first and second opposed members 18, 20 toward one another. Such action accelerates game play, and enhances the difficulty level for an opponent preparing to "defend" their goal position 36.

Figure 2:
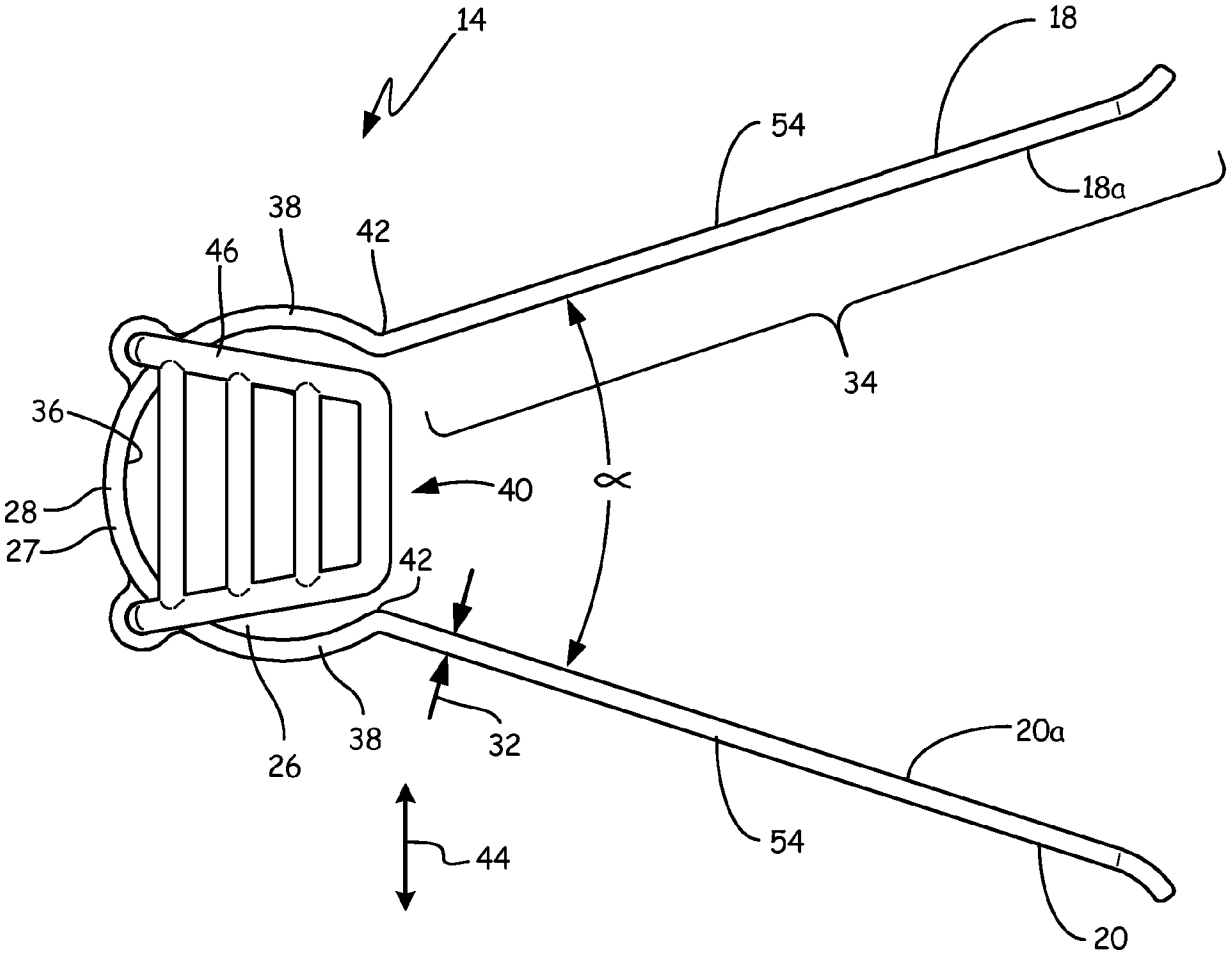
FIG. 2 is a top plan view of a portion of the game apparatus illustrated in FIG. 1.
Figure 3:
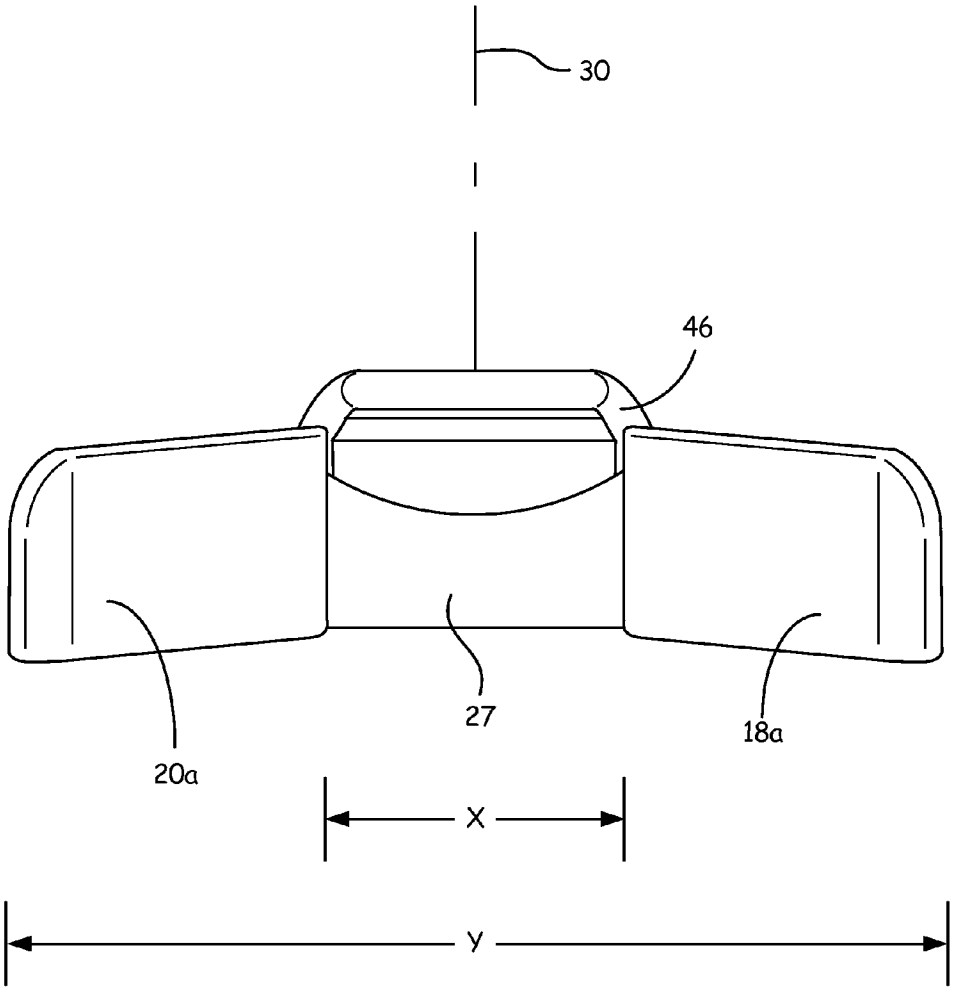
FIG. 3 is an end elevational view of the portion of the game apparatus illustrated in FIG. 2.

A top plan view of a pincer tool 14 is illustrated in FIG. 2. First and second opposed members 18, 20 extend from a pivot or pivot region 28 so as to be articulatable about a pivot axis 30 of pivot 28. Depending upon the construction of pincer tool 14, pivot axis 30 may or may not be confined to a single axis, and may instead include a plurality of substantially parallel axes about which first and second members 18, 20 operably rotate. In this regard, pincer tool 14 may generally "flex" about one or more regions to permit the manual articulation of first and second members 18, 20 with respect to one another.

In the illustrated embodiment, first and second opposed members 18, 20 are integrally formed with one another, merging at pivot 28 as a single molded body. It is contemplated that pincer tool 14 may be fabricated from a material and/or material thickness that provides a desired extent of flexibility in articulating first and second opposed members 18, 20 about pivot 28. It is contemplated, therefore, that pincer tool 14 may be fabricated from molded polymeric materials, metals, alloys, and the like that, either through their material properties, the pincer tool thicknesses, or combinations thereof, pincer tool 14 may be flexed so that first and second opposed members 18, 20 are articulatable under moderate human hand pressure about pivot axis 30. In an example embodiment, pincer tool 14 may be a molded polymeric body having a nominal wall thickness 32 of about 0.1 in. An example polymeric material for pincer tool 14 may be acrylic, though it is contemplated that other polymeric and non-polymeric materials are suitable in the manufacture of pincer tool 14 to provide both durability and flexibility at pivot 28. It is also contemplated that pincer tool 14 may be fabricated with a plurality of materials and/or mechanical hinges to obtain desired operational characteristics.

Pincer tool 14 includes a discharge portion 34 that is capable of accelerating game piece 12 radially outwardly from pivot axis 30, such as along direction 22, by articulating at least one of first and second opposed members 18, 20 about pivot axis 30 toward another of first and second opposed members 18, 20 while game piece 12 is in contact with both of first and second opposed members 18, 20 at discharge portion 34. This arrangement is illustrated in FIG. 1, and is a consequence of the first and second opposed members 18, 20 being arranged in a mutually angled relationship defining a pincer angle "α" between respective facing inner surfaces 18*a*, 20*a* of first and second opposed members 18, 20. Due to the pincer angle "α", articulation of at least one of first and second opposed members 18, 20 to reduce pincer angle "α" has the effect of propelling game piece 12 radially outwardly from pivot axis 30. As inner surfaces 18*a*, 20*a* of first and second members 18, 20 are brought closer together through the articulation of at least one of first and second members 18, 20 about pivot axis 30, a game piece 12 engaged between inner surfaces 18*a*, 20*a* is caused to move radially outwardly along discharge portion 34. Continued relative articulation of first and second opposed members 18, 20 propels game piece 12 radially outwardly from pincer tool 14.

Receptacle 26 is arranged to receive game piece 12 at a goal position 36 radially inwardly of discharge position 34, with "radially inwardly" being defined with respect to a perpendicular radial axis from pivot axis 30 extending out through pincer channel 58. Receptacle 26 is defined by respective receptacle portions 38 of first and second opposed members 18, 20, which receptacle portions 28 are proximate to pivot 28 with respect to discharge portion 34. Receptacle portions 38 merge at pivot 28 to form a closed end 27 of receptacle 26 adjacent to pivot 28. Receptacle portions 38 further define an open end 40 of receptacle 26 adjacent to transition portion 42 of pincer tool 14. Transition portion 42 may be intermediate of discharge portion 34 and receptacle portions 38.

In the illustrated embodiment, pincer tool 14 is provided with an unstressed configuration that can be placed in a stressed condition through, for example, articulation of first and second opposed members 18, 20 about pivot axis 30. Application of a pinching force to first and second opposed members 18, 20 along directional arrows 24*a*, 24*b* places pincer tool 14 in a stressed condition in which a rebound bias force is generated at pivot 28 to restore pincer tool 14 to its unstressed condition. Such rebound bias force acts against the pinching force applied to first and second opposed members 18, 20. It is contemplated that the restorative rebound bias force may be generated as a result of the flexure of pincer tool 14 at pivot 28, or may instead be provided by a compression spring, a resilient cushion, or any other mechanism suitable for supplying a bias force urging first and second members 18, 20 of pincer tool 14 into an open configuration in which transition dimension "X" and the maximum discharge portion dimension "Y" are greater than a cross-sectional diameter "Z" of game piece 12. Such dimensional relationships maintain an unobstructed pathway for game piece 12 to enter receptacle 26, and requires manipulation of pincer tool 14 by the player to "catch" or stop game piece 12 from entering receptacle 26. In an example embodiment, an unstressed condition for pincer tool 14 results in a pincer angle "α" of about 40°.

While relative movement of first and second opposed members 18, 20 has been described herein as pivoting about pivot axis 30, other relative motions between first and second opposed members 18, 20 are contemplated as being useful in pincer tool 14. For example, pincer tool 14 may be provided with a mechanism for translationally moving first and second opposed members 18, 20 toward and away from one another. Such translational movement may be, for example, along a translational axis 44. Moreover, it is contemplated that combinations of angular and translational relative motion may be employed for first and second opposed members 18, 20 to selectively catch and relaunch game piece 12 as described herein.

Figure 4:
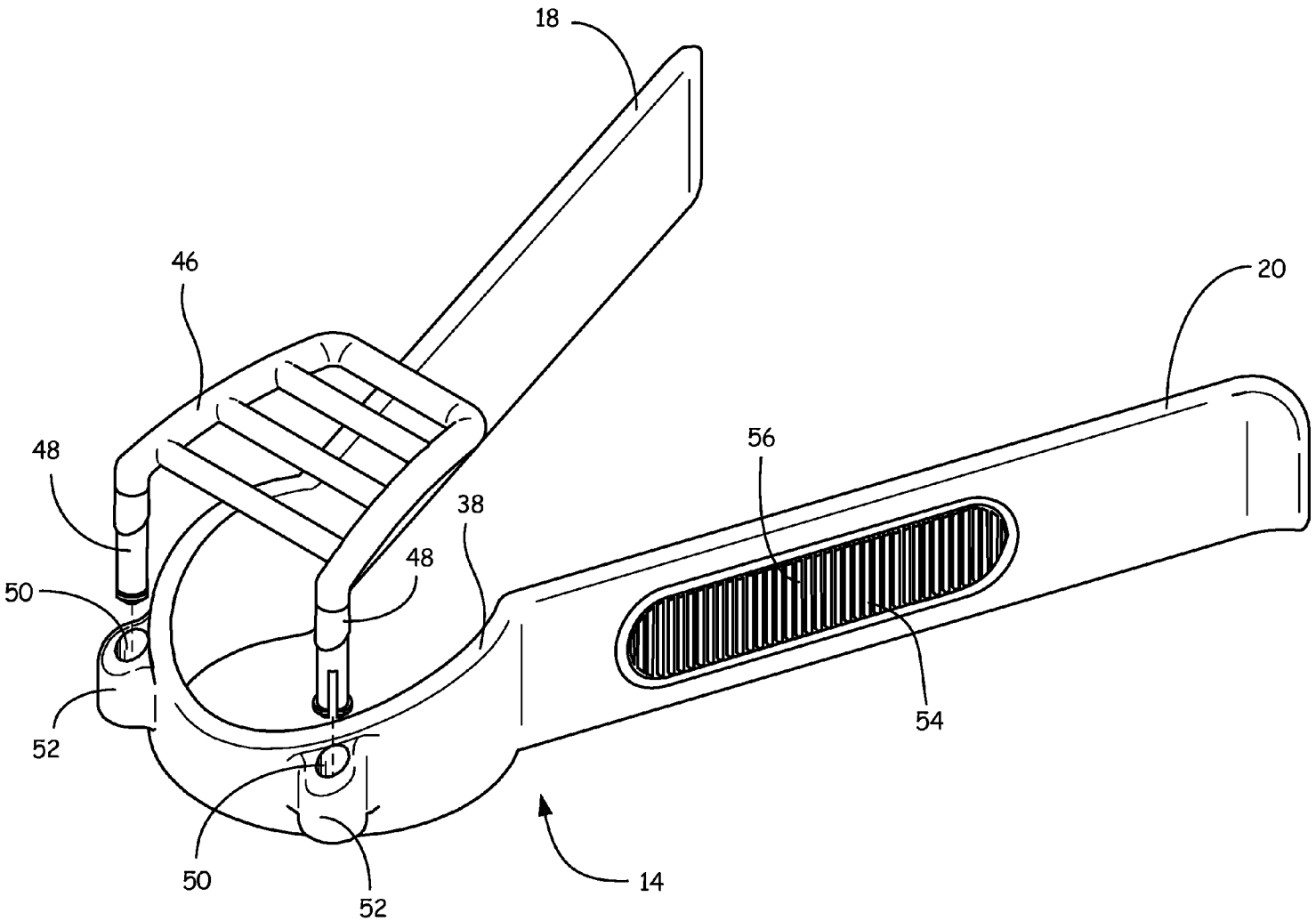
FIG. 4 is an exploded perspective view of the portion of the game apparatus illustrated in FIGS. 2 and 3.

In some embodiments, a goal indicator 46 may be secured to pincer tool 14 for identifying goal position 36 at pincer tool 14. Goal indicator 46 may be provided in a variety of configurations, and may be specifically arranged to designate a particular type of goal scoring game, such as basketball, hockey, soccer, and the like. Securement of goal indicator 46 to pincer tool 14 is illustrated in the exploded view of FIG. 4, wherein pins 48 may be received in pin channels 50 of securement nodes 52 extending from receptacle portions 38. Goal indicator 46 may serve merely an aesthetic purpose, or may also establish a lid to prevent the escape of game piece 12 from receptacle 26 through any pathway other than open end 40 of receptacle 26. Goal indicator 46 may further provide a safety feature as preventing deflection of a moving game piece 12 up and out from receptacle 26. In this manner, goal indicator 46 may prevent injury caused by game piece 12 from exiting receptacle 26 and striking the player.

Grip elements 54 may be provided at outer surfaces 18*b*, 20*b* of first and second opposed members 18, 20 to aid the player in grasping pincer tool 14. Grip elements 54 may be integrally formed with first and/or second opposed members 18, 20, or may be separate structures adhered or otherwise secured to first and/or second opposed members 18, 20. Grip elements 54 provide a grip surface 56 that has a tacky or friction-inducing surface structure which assists the player in maintaining the hold upon pincer tool 14.

Figure 5C:
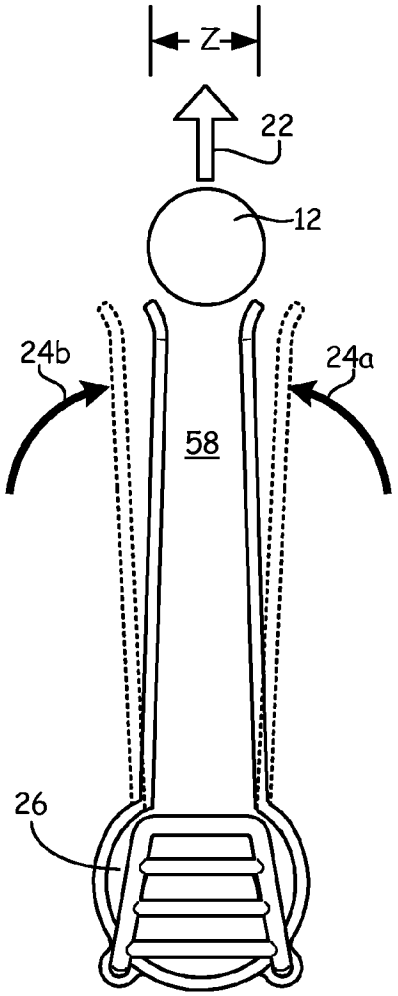
FIG. 5C is a schematic illustration of a game apparatus of the present invention in a game piece discharge condition.
Figure 5B:
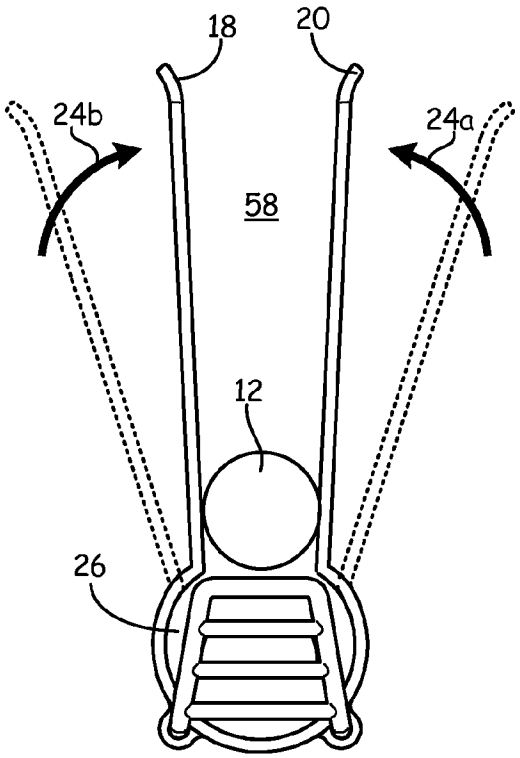
FIG. 5B is a schematic illustration of a game apparatus of the present invention in a game piece caught condition.
Figure 5A:
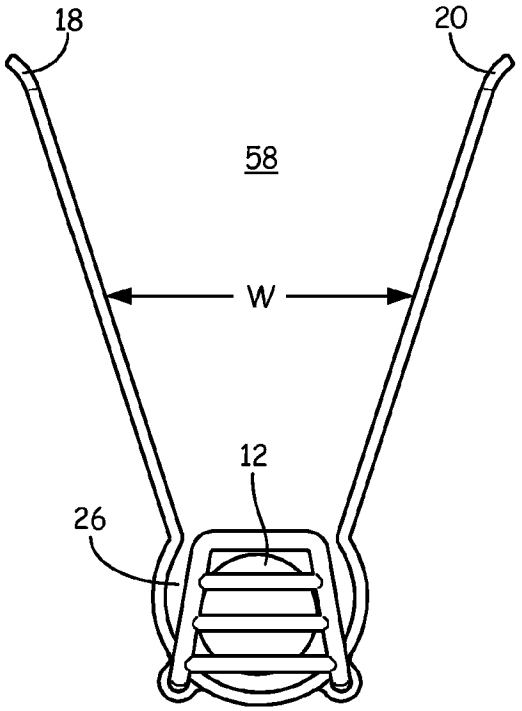
FIG. 5A is a schematic illustration of a game apparatus of the present invention in a goal scored condition.

FIGS. 5A-5C illustrate various operating conditions for game apparatus 10. A "goal" condition of game apparatus 10 may be established in the event that game piece 12 is received in an opponent's receptacle 26. Other goal conditions, however, are contemplated as being utilized for game apparatus 10. For example, a goal condition may be established in the event that game piece 12 reaches a designated region of game area 5, such as a goal region behind the opposing player's pincer tool 14. In game play involving a goal condition in the event that game piece 12 is received in an opponent's receptacle 26, the opponent may attempt to prevent game piece 12 from entering receptacle 25 by pinching or squeezing or otherwise manipulating first and second members 18, 20 toward one another as game piece 12 is received in pincer channel 58. In this regard, the player attempts to "catch" game piece 12 between first and second members 18, 20 before game piece 12 enters receptacle 26. A caught condition of game piece 12 is illustrated in FIG. 5B, wherein first and second opposed members 18, 20 are moved toward one another as indicated by directional arrows 60, 24*a*, 24*b*. In the illustrated embodiment, relative movement of first and second opposed members 18, 20 is accomplished through articulation about pivot axis 30. In other embodiments, such relative movement may be accomplished by moving one or more of first and second opposed members 18, 20 angularly or translationally toward another of first and second opposed members 18, 20 to reduce pincer channel width "W". In the event that the player is successful in capturing game piece 12 between first and second members 18, 20 prior to game piece 12 entering receptacle 26, no goal is awarded to the other player. In some embodiments, a point or other reward may be given to the player who successfully captures game piece 12 in a catch condition, as illustrated in FIG. 5B.

Figure 6:
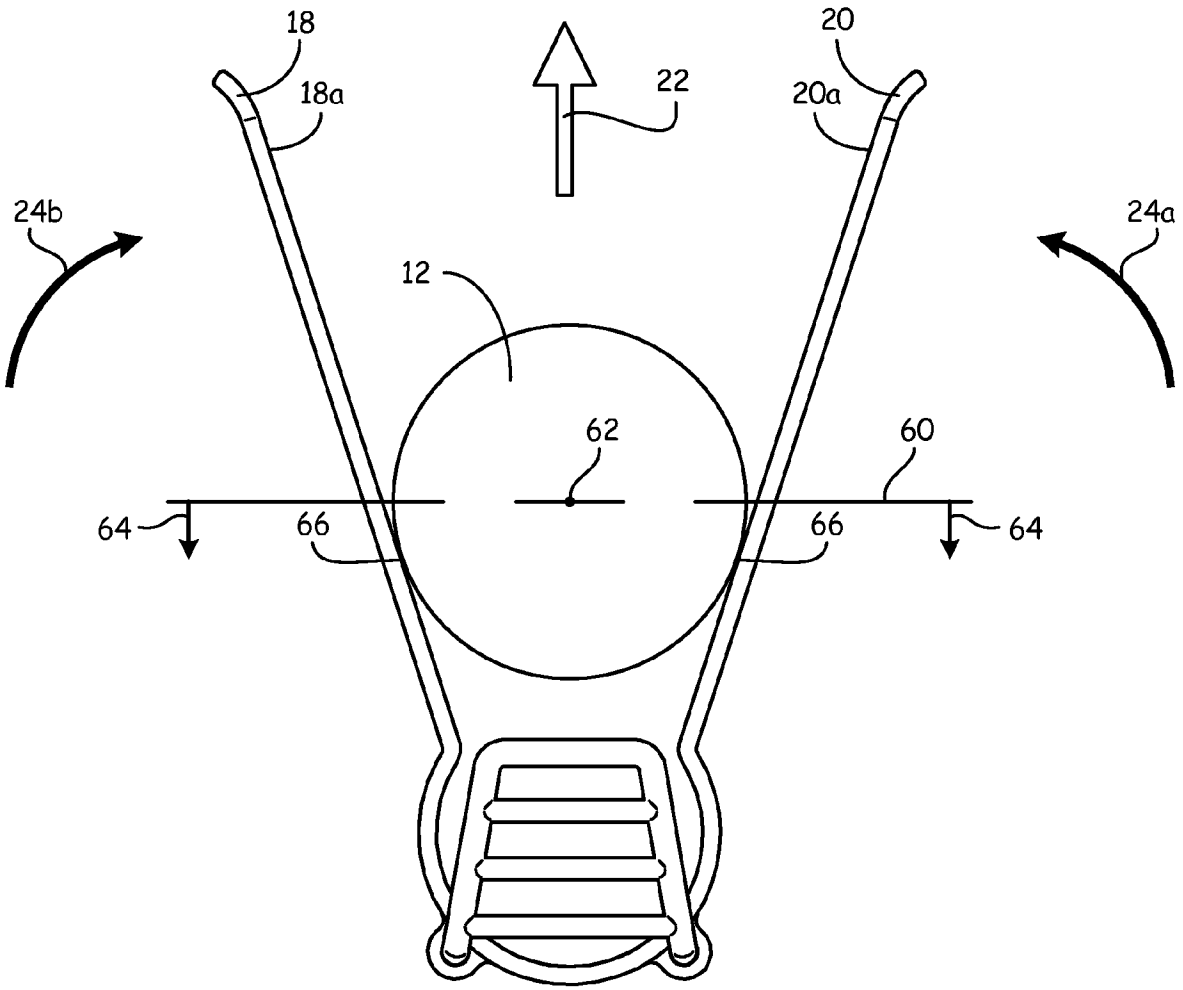
FIG. 6 is a schematic illustration of a game apparatus of the present invention.
Figure 7B:
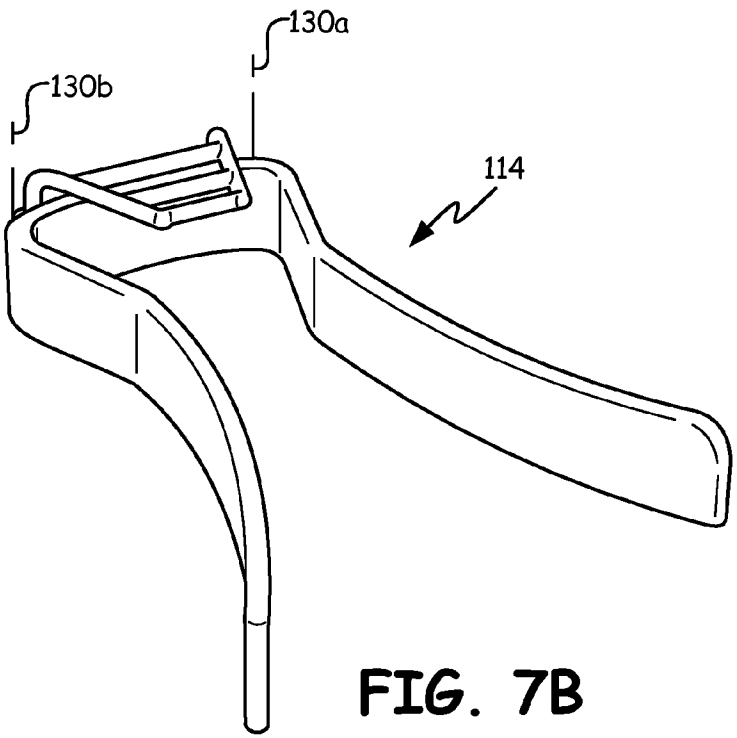
FIG. 7B is a front perspective view of the portion of the game apparatus illustrated in FIG. 7A.
Figure 7A:
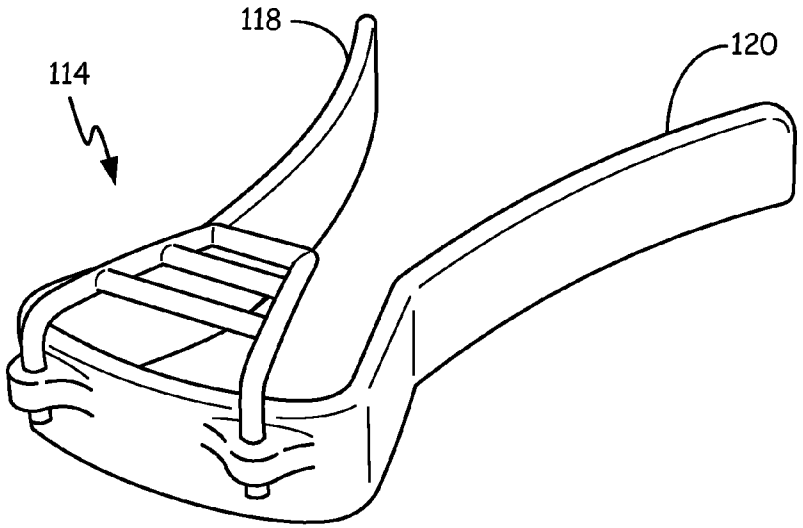
FIG. 7A is a rear perspective view of a portion of a game apparatus of the present invention.
Figure 7C:
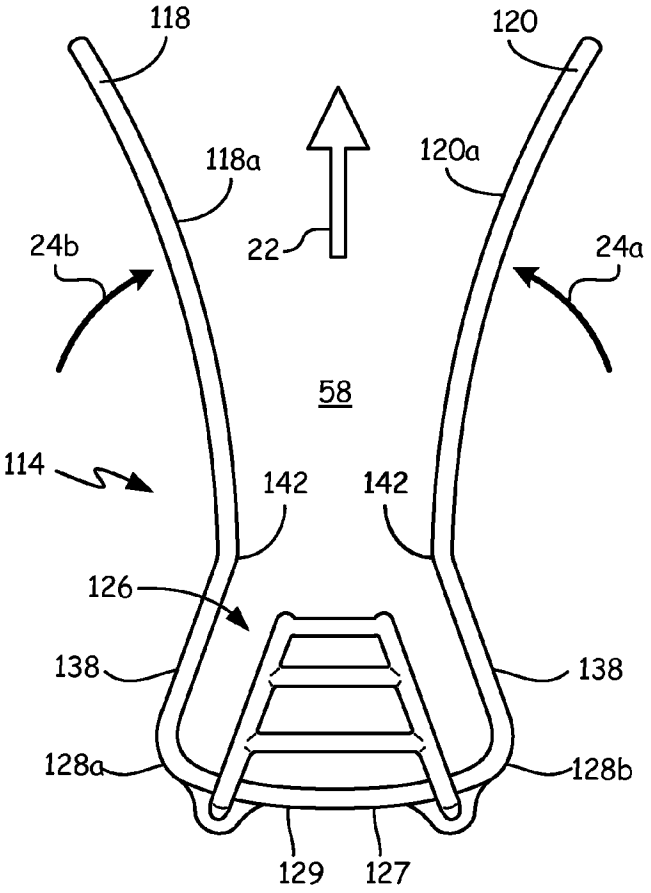
FIG. 7C is a top plan view of the portion of the game apparatus illustrated in FIGS. 7A and 7B.

Pincer tool 14 may be manipulated to propel game piece 12 radially outwardly from pincer channel 58 along direction 22. The discharge of game piece 12 from pincer channel 58 is illustrated in FIG. 5C, and is accomplished by further pinching or squeezing first and second members 18, 20 toward one another along direction arrows 24*a*, 24*b*. In this manner, a velocity for game piece 12 is developed without a striking force in the collision of a striking device against game piece 12. Instead, game piece 12 is translationally motivated along inner surfaces 18*a*, 20*a* of first and second opposed members 18, 20 as game piece 12 is in substantially simultaneous contact with both of first and second opposed members 18, 20. The translational movement of game piece 12 is developed as a consequence of the mutual angular relationship of first and second opposed members 18, 20. In particular, pincer tool 14 is arranged to cooperate with game piece 12 by simultaneously contacting game piece 12 at points or areas on the same side of a dividing midplane 60 of game piece 12. A schematic view of such relationship is illustrated in FIG. 6. In this example schematic, game piece 12 has a substantially circular cross-section, but it is to be understood that the mechanism of pincer tool 14 for developing translational movement for game piece 12 is also applicable to non-circular cross-section game pieces 12. Midplane 60 of game piece 12 defines a maximum cross-sectional dimension for game piece 12, and, in the case of a circular cross-section game piece 12, its diameter passing through center 62. As is apparent from the schematic illustration of FIG. 6, first and second opposed members 18, 20 are arranged to each contact game piece 12 on a common side 64 of midplane 60. Contact points 66 are both on side 64 of game piece midplane 60, which side 64 is oriented "radially inwardly" of midplane 60 as a consequence of the diverging relationship of first and second members from transition portion 42. Manipulation of first and second opposed members 18, 20 along directional arrows 24*a*, 24*b* forces game piece 12 along inner surfaces 18*a*, 20*a* along direction 22.

Example alternative embodiments of the pincer tools of the present invention are illustrated in FIGS. 7A-7C and 8A-8C. Pincer tool 114 illustrated in FIGS. 7A-7C includes a modified configuration for first and second members 118, 120 as compared to first and second members 18, 20 of pincer tool 14. Namely, first and second members 118, 120 include a radiused configuration to provide a convex curvature for inner surfaces 118*a*, 120*a*. Such curvature of first and second members 118, 120 permits the employment in game apparatus 10 of certain game pieces 12 that may not desirably operate in cooperation with pincer tool 14. For example, a cube or other polygon may be captured and re-launched through the convexly curved first and second members 118, 120, whereas the substantially linear first and second members 18, 20 of pincer tool 14 may be effective in catching such a game piece configuration, but may have difficulty in re-launching game piece 12 as a result of inner surfaces 18, 20 equally contacting directly opposed and parallel sides of game piece 12, such that the squeezing or pinching force applied to game piece 12 may not cause game piece 12 to translate along inner surfaces 18*a*, 20*a* to be propelled out from pincer tool 14. The curved first and second members 118, 120 of pincer tool 114, by contrast, facilitates translation of game piece 12 along inner surfaces 118*a*, 120*a* during a pinching action of first and second members 118, 120 along direction arrows 24*a*, 24*b* since pressure against the opposed sides of game piece 12 is relieved as game piece 12 moves along direction 22 and ultimately out from pincer channel 58.

Receptacle portions 138 are also somewhat differently configured that receptacle portions 38 of pincer tool 14, and may be configured so as to establish a plurality of pivots, including pivots 128*a*, 128*b*. In such arrangement, it is to be understood that the pincer tools of the present invention may include one or more pivots defining respective pivot axes, such as pivot axes 130*a*, 130*b* about which first and second members 118, 120 may be operably articulated. The unitary construction of pincer tool 114 may result in an additional pivot 129, wherein flexure of pincer tool 114 during the pinching or squeezing action upon first and second members 118, 120 may cause flexing at multiple locations of receptacle portions 138. It is therefore contemplated that the pincer tools of the present invention may employ a plurality of distinct pivot locations and pivot axes which may or may not be distinctly defined at discrete locations of the pincer tool. Instead, it is contemplated that the pincer tools of the present invention exhibit one or more of discrete pivot locations and overall flexibility and/or resilience in order to accommodate the flexing operation of the first and second opposed members in the catching and re-launching of game piece 12.

Receptacle portions 138 extend from transition portion 142 generally linearly toward pivot corners 128*a*, 128*b*, and coming together at closed end 127 of receptacle 126. It is contemplated that first and second members 118, 120 may primarily flex or pivot at corner pivots 128*a*, 128*b* about respective pivot axes 130*a*, 130*b*, though it is also contemplated that pivoting or flexure may occur at closed end 127, as well as other locations of receptacle portions 138 and first and second portions 118, 120.

Figure 8A:
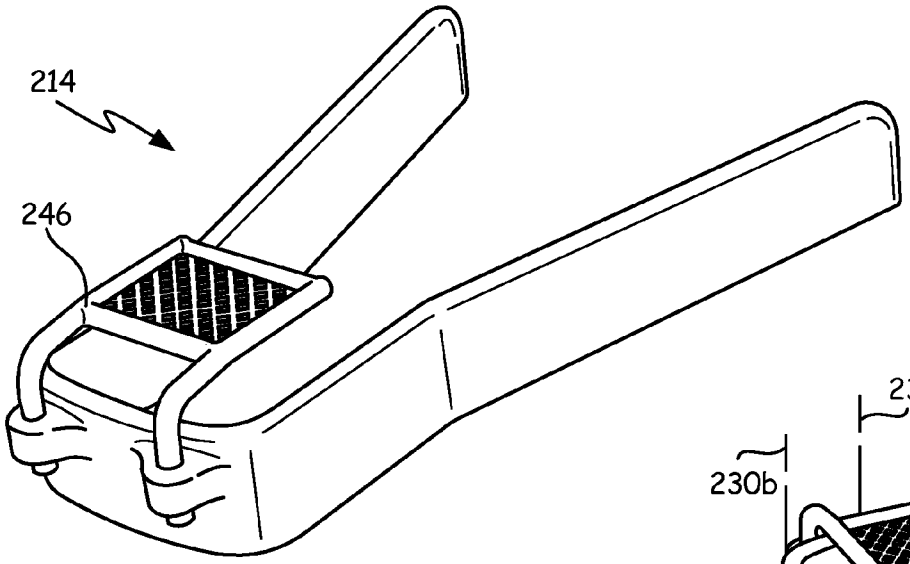
FIG. 8A is a rear perspective view of a portion of a game apparatus of the present invention.
Figure 8B:
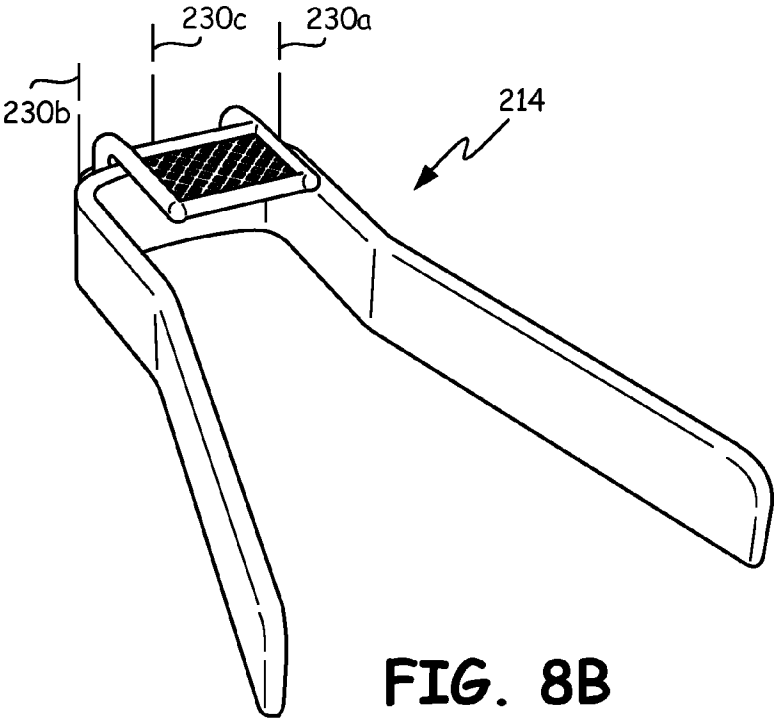
FIG. 8B is a front perspective view of the portion of the game apparatus illustrated in FIG. 8A.
Figure 8C:
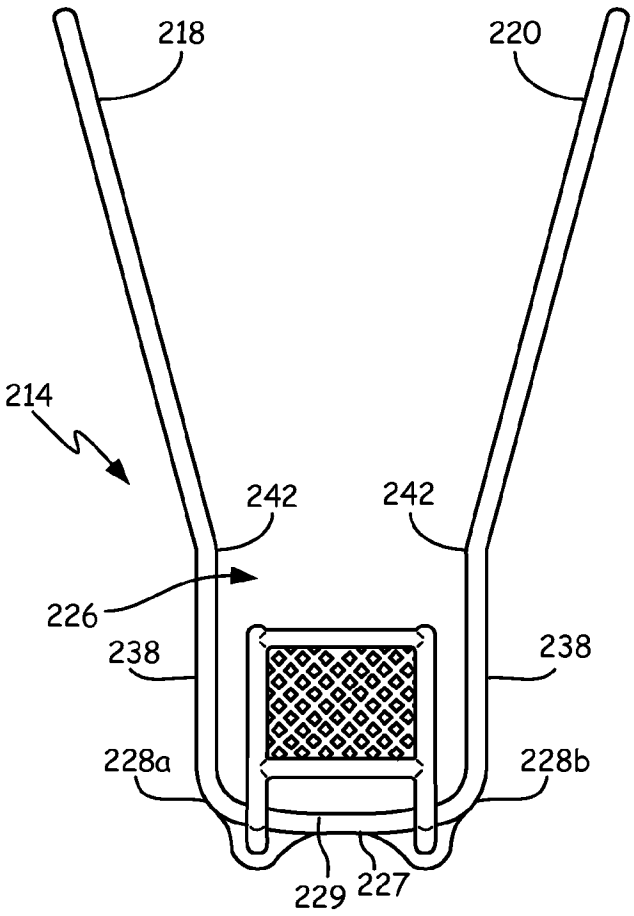
FIG. 8C is a top plan view of the portion of the game apparatus illustrated in FIGS. 8A and 8B.

An alternative embodiment of the present invention is illustrated in FIGS. 8A-8C, wherein pincer tool 214 is illustrated with substantially linear first and second opposed members 218, 220 extending from transition portion 242, and receptacle portions 238 extending substantially linearly from transition portion 242 to corner pivots 228*a*, 228*b*, and coming together at closed end 227 of receptacle 226. In this configuration, pincer tool 214 may likely flex and pivot somewhat similarly to pincer tool 114, such as at and about pivot axes 230*a*, 230*b*, and at and about pivot axis 230*c* at center pivot 229. It is also to be understood that pincer tool 214 may flex and pivot at a plurality of locations of receptacle portions 238 and first and second opposed members 218, 220. As may also be appreciated in FIGS. 8A-8C, goal indicator 246 exhibits a different configuration from goal indicator 46, and may convey a different "type" of sport association, such as basketball, soccer, hockey, or the like.

Figure 9:
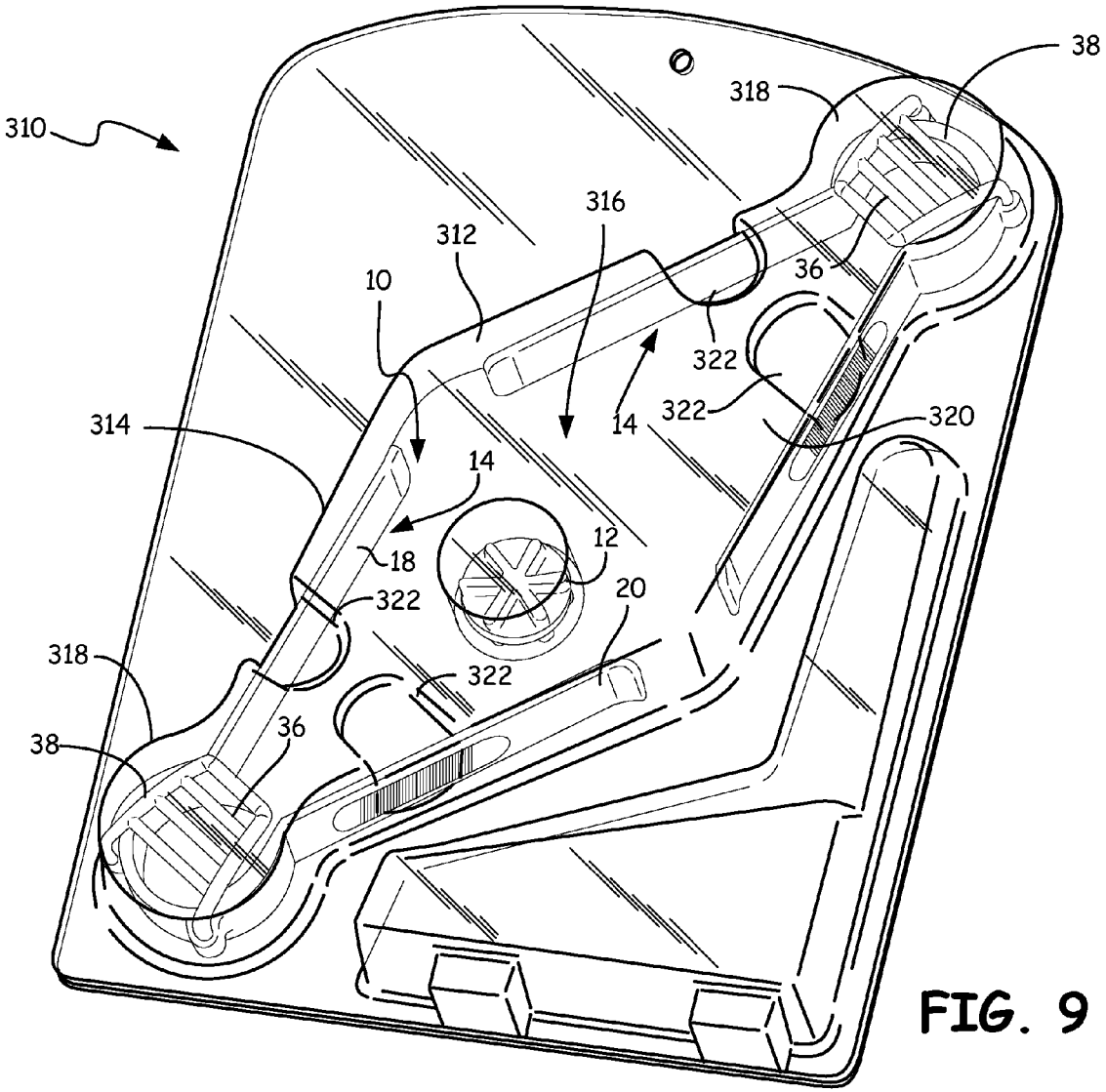
FIG. 9 is a perspective view of a game apparatus of the present invention secured within packaging of the present invention.
Figure 10:
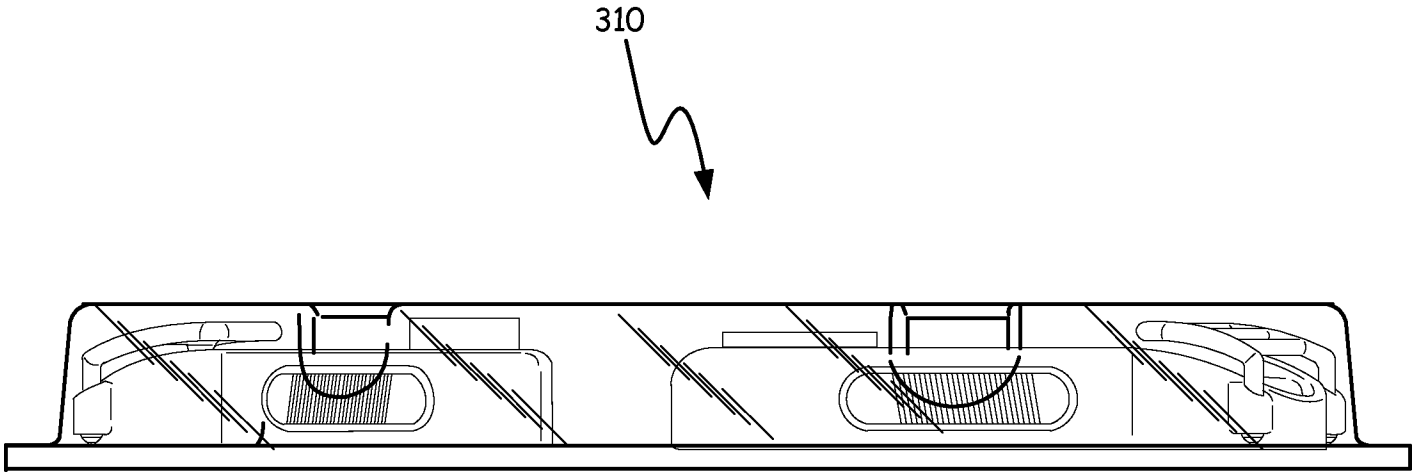
FIG. 10 is a side elevational view of the apparatus in packaging illustrated in FIG. 9.

Another aspect of the present invention is illustrated in FIGS. 9 and 10, wherein interactive packaging 310 is designed to simultaneously display and permit limited play of game apparatus 10 while game apparatus 10 is secured within packaging 310. Interactive packaging 310 may be in the form of "blister" packaging that is commonly employed in the marketing and sales of consumer goods. Such blister packaging typically includes two plastic bodies, which may be substantially transparent, and that are sealed or otherwise connected together about the displayed product. A blister or blisters are provided in the packaging as expanded volumes in which the respective product may be securely positioned between the two sides of the packaging for display.

In the present invention, interactive packaging 310 includes an apparatus blister 312 in which game apparatus 10 is securely positioned. Apparatus blister 312 includes a side wall 314 defining a perimeter about a demonstration area 316 in which the operation of game apparatus 10 may be demonstrated. Apparatus blister 312 includes first and second pincer tool pockets 318 that are specifically configured to securely receive receptacle portions 38 of pincer tools 14 therein in respective facing orientation, as illustrated in FIG. 9. In such orientation, two pincer tools 14 are arranged in an orientation similar to that anticipated in a regular game playing situation, with pincer channels 58 of respective pincer tools 14 opening in a direction toward an opposing pincer tool channel 58. Apparatus blister 312 further includes a top wall 320 enclosing demonstration area 316.

To permit operation of game apparatus 10 while game apparatus 10 is positioned inside of apparatus blister 312, interactive cutouts 322 are provided in side wall 314 and top wall 320 of apparatus blister 312, with interactive cutouts 322 providing access to first and second members 18, 20 of respective pincer tools 14. A prospective buyer of apparatus 10 may therefore access and manipulate first and second opposed members 18, 20 of one or both of the displayed pincer tools 14 to articulate first and second members 18, 20 about pivot 28. Moreover, game piece 12 may be released into demonstration area 316, such that manipulation by a prospective purchaser of apparatus 10 may actually catch and launch game piece 12 toward an opposing goal position 36 as a demonstration of how the game is played.

The invention has been described herein in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A game apparatus, comprising:

a game piece for movement upon a game surface, said game piece having a diameter defining a maximum linear dimension of said game piece; and a pincer tool for catching and discharging said game piece along the game surface under force, said pincer tool having first and second opposed members and extending from a pivot region to be articulatable about a pivot axis of said pivot region, a discharge portion of said pincer tool being capable of accelerating said game piece radially outwardly with respect to said pivot axis by articulating at least one of said first and second opposed members about said pivot axis toward another of said first and second opposed members while said game piece is in contact with both of said first and second opposed members at said discharge portion, said pincer tool including a receptacle having a closed end adjacent to or including said pivot region, and an open end that is bound by a transition portion of said pincer tool to define an opening into said receptacle, said transition portion being intermediate of said discharge portion and said receptacle, and comprising respective portions of said first and second opposed members that are separated by a transition dimension, wherein said transition dimension is selectively adjustable between being larger than said game piece diameter, and being smaller than said game piece diameter by articulating at least one of said first and second opposed members about said pivot axis toward another of said first and second opposed members, with adjustment of said transition dimension correspondingly adjusting an opening dimension of the opening, said receptacle being arranged to receive said game piece at a goal position radially inwardly of said transition portion, said receptacle being defined by respective receptacle portions of said first and second opposed members extending from said pivot region to said transition portion, wherein said receptacle remains larger than said game piece diameter when said transition dimension is equal to or smaller than said game piece diameter.

2. A game apparatus as in claim 1 wherein said discharge portion is defined by said first and second opposed members arranged in a mutually diverging relationship, with a pincer angle being defined between respective facing inner surfaces of said first and second opposed members.

3. A game apparatus as in claim 2 wherein articulating said first and second opposed members about said pivot axis toward one another changes said pincer angle.

4. A game apparatus as in claim 1 wherein articulation of said first and second opposed members about said pivot axis toward one another opposes a bias force.

5. A game apparatus as in claim 1 wherein said first and second opposed members are integrally formed with one another, and merge at said pivot region.

6. A game apparatus, comprising:

a game piece;

first and second pincer tools for catching and discharging said game piece, each of said first and second pincer tools having divergent first and second pincer members that are flexible toward one another against a bias, and divergently extending distally from a goal portion defining a receptacle sized to receive said game piece; and a package for containing said game piece and said first and second pincer tools within a cavity defined between a package base and a package blister covering said package base, said package blister retaining said first and second pincer tools in said cavity in an orientation in which said first and second pincer tools open toward one another along a common plane, said package blister having openings positioned to permit a user to manipulate said pincer members of said first and second pincer tools against their respective bias while said first and second pincer tools are contained within said cavity, wherein said game piece is capable of traveling within said cavity from said receptacle of said first pincer tool to said receptacle of said second pincer tool.

7. A game apparatus as in claim 6 wherein said package blister is substantially transparent.

8. A method for playing a game, said method comprising:

(a) providing a game apparatus having:

(i) a game piece having a diameter defining a maximum linear dimension of said game piece; and (ii) first and second pincer tools for catching and discharging said game piece, each of said pincer tools having first and second pincer members defining a pincer channel therebetween, the pincer channel communicating with a receptacle defining a goal zone at a closed end portion of said pincer tool, said receptacle having an open end between respective transition portions of said first and second pincer members that are separated at said transition portions by a transition dimension;

(b) catching said game piece in said pincer channel by articulating at least one of said first and second pincer members about a pivot axis toward another of said first and second pincer members to an extent to adjust said transition dimension to a size that is equal to or smaller than said game piece diameter while said goal zone remains larger than said game piece diameter, thereby contacting said game piece with both of said first and second pincer members; and (c) propelling said game piece toward said goal zone of an opponent's pincer tool by moving at least one of said first and second pincer members toward the other of said first and second pincer members while said game piece remains in contact with both of said first and second pincer members.

9. A method as in claim 8, including receiving said game piece in said goal zone.

10. A method as in claim 9 wherein said game piece passes through the open end of said receptacle to be received in said goal zone.

11. A method as in claim 8, including placing said game piece on a game surface, said game piece being propelled along said game surface between said first and second pincer tools.

* * * * *